US005279083A

United States Patent [19]

Savorani

[11] Patent Number: 5,279,083

[45] Date of Patent: Jan. 18, 1994

[54] MODULAR FRAME FOR DEFINING AND PROFILING THE EDGES OF WELLS, CANALIZATIONS FOR OPENINGS IN GENERAL

[75] Inventor: Sandra Savorani, Forli', Italy

[73] Assignee: Edil Plast S.R.L., Forli, Italy

[21] Appl. No.: 776,775

[22] Filed: Oct. 18, 1991

[30] Foreign Application Priority Data

Oct. 18, 1990 [IT] Italy ..... 15162/90[U]

[51] Int. Cl.[5] ..... E04C 2/38

[52] U.S. Cl. ..... 52/102; 52/21; 52/593; 52/716.1

[58] Field of Search ..... 52/102, 716, 717, 718, 52/475, 476, 656, 589, 590, 591, 592, 593, 102, 29, 20, 21, 244, 608, 609

[56] References Cited

U.S. PATENT DOCUMENTS

| | | | |
|---|---|---|---|
| 609,940 | 8/1898 | Koehler | 52/284 |
| 2,178,282 | 10/1939 | Keary | 52/609 |
| 4,299,070 | 11/1981 | Oltmanns et al. | 52/403 |
| 4,708,898 | 11/1987 | Gommier et al. | 428/36 |
| 5,009,047 | 4/1991 | Olding | 52/244 |
| 5,114,270 | 5/1992 | Riddle | 405/15 |

FOREIGN PATENT DOCUMENTS

| | | |
|---|---|---|
| 0083007 | 7/1983 | European Pat. Off. . |
| 41198 | 7/1937 | Netherlands . |
| 47222 | 11/1939 | Netherlands . |
| 1307370 | 2/1973 | United Kingdom . |
| 2185053 | 7/1987 | United Kingdom . |

*Primary Examiner*—Carl D. Friedman
*Assistant Examiner*—Matthew E. Leno
*Attorney, Agent, or Firm*—Stevens, Davis, Miller & Mosher

[57] ABSTRACT

This invention relates to a modular frame which is made up of a suitable plastic material and is capable of giving the correct L-shaped profile to the upper edges of wells or of canalizations or of openings in general and is prepared so as to give the possibility of anchoring the same strongly to the cement mortar employed for its installation.

24 Claims, 4 Drawing Sheets

MODULAR FRAME FOR DEFINING AND PROFILING THE EDGES OF WELLS, CANALIZATIONS FOR OPENINGS IN GENERAL

This finding relates to a modular frame which is made up of a suitable plastic material and is capable of giving a correct L profile to the top edges of wells or of canalizations or to the edges of openings in general, said frame being arranged so as to be strongly anchored to the cement mortar that fixes it in the installation of the same.

The characteristics of the frame in question and the advantages deriving therefrom will be evident from the following disclosure which is given with reference to the figures shown in the enclosed three drawing sheets, wherein.

Figure 1:
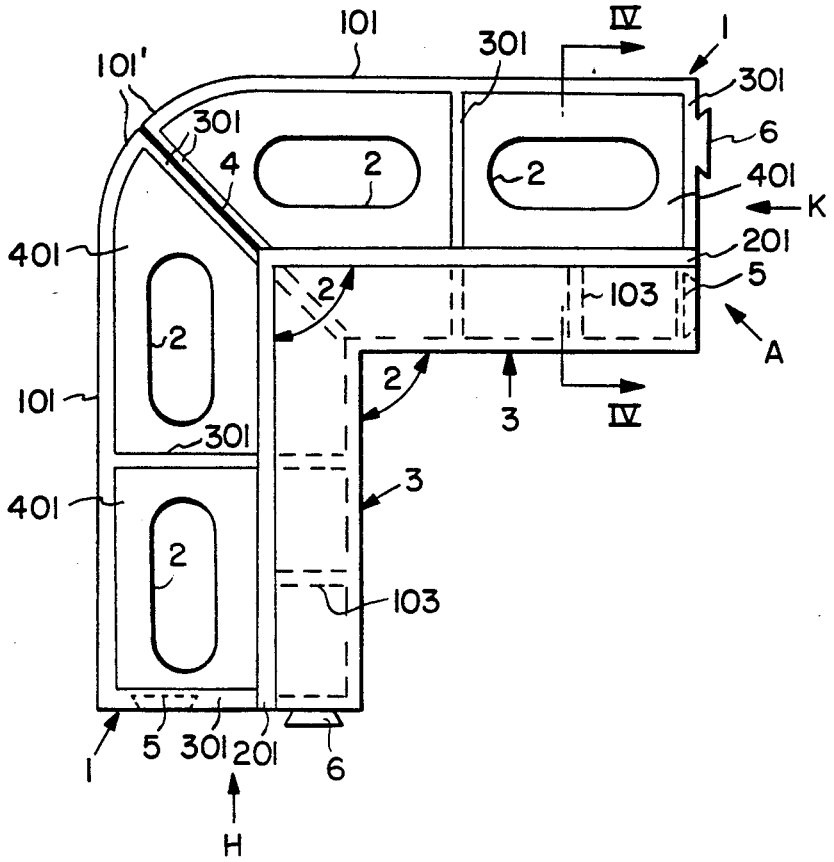
FIG. 1 is a top plan view of the angular member of said frame.
Figure 2:
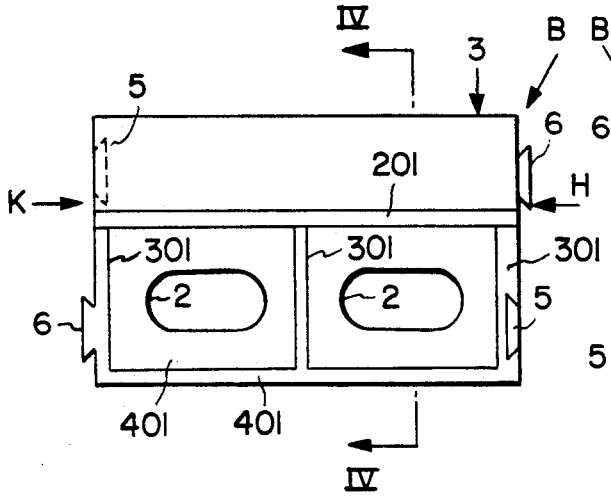
FIGS. 2 and 3 are a top plan view and a bottom plan view of an intermediate member of the frame, respectively.
Figure 3:
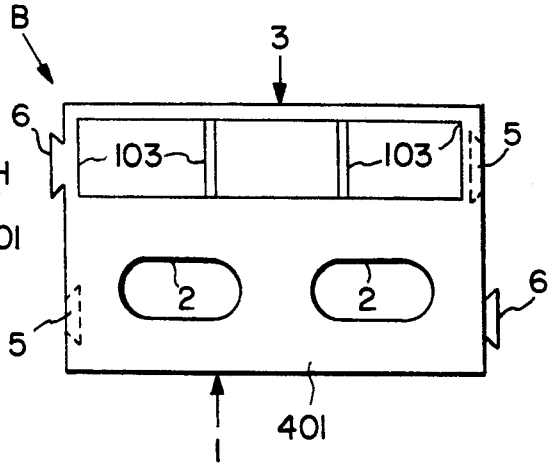
Figure 7:
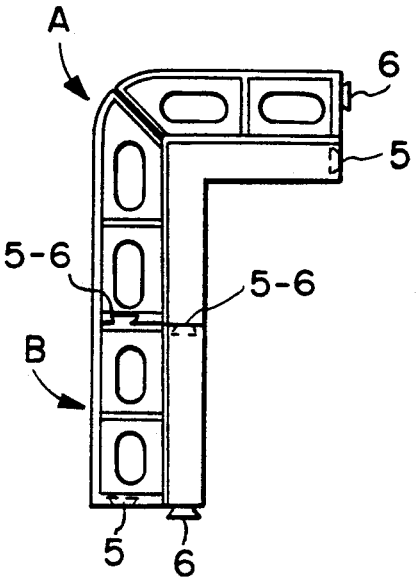
FIG. 7 and 8 illustrate some possible compositions of the modules for the realization of the modular frame in question.
Figure 8:
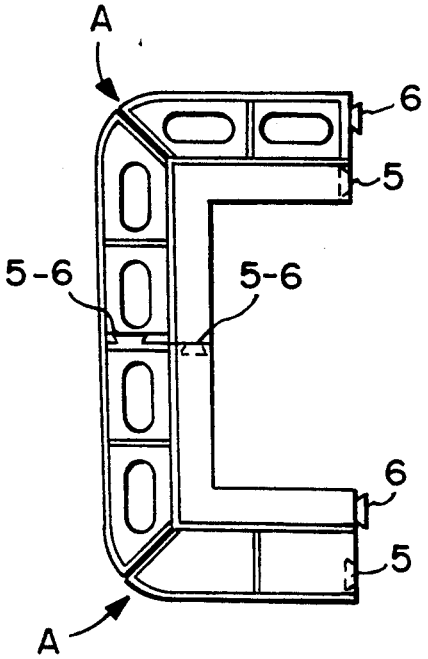

The modular frame which is the object of this invention is made by mold injection of any suitable plastic material provided with a good resistance to physical-chemical stresses and having a heat expansion coefficient close to that of the cement mortar employed for the installation of the frame itself. The frame is made up mainly of two pieces. It consists of a member that defines the 90° angular portions of the frame as shown for instance by A-A'-A" and A'" in the FIGS. 1-9-10-11, and of at least an intermediate, straight-line member B as shown in FIG. 2. Both elements A-A'-A"-A'" and B are provided at their ends with fixing means so that they can be connected to each other in a very rapid way, for instance with raised members or with dovetail profile cavities (see further in this disclosure). FIG. 7 illustrates two consecutive sides of a frame which is made up of an angular member A, in the shape of a square, and of a member B which is connected to an end of A for extending at one's will the side of the frame. FIG. 8 illustrates on the contrary three consecutive sides of a frame which are formed by the reciprocal connection of two angular members A. The variants of the angular members or of the end members of the frame, shown by the letters A'-A" and A'" and illustrated in FIGS. 9, 10 and 11, will be considered further in the present disclosure.

In order to meet the various requirements of the market, the members A-A'-A"-A'" and B can be manufactured in combination with different sizes.

Figure 4:
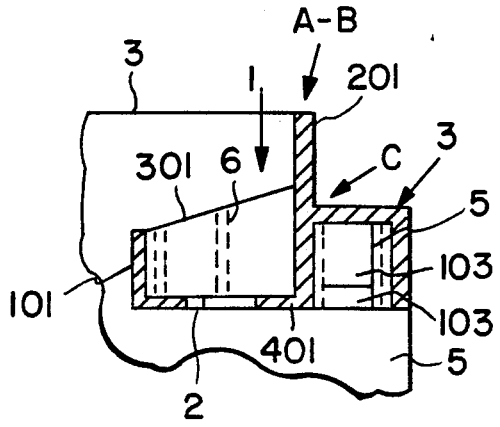
FIG. 4 illustrates some structural details of the components shown in FIGS. 1 and 2, which have been cross-sectioned along the line IV—IV.

With reference now to FIG. 4, the particular profile of the members A-A'-A"-A'" and B will be now disclosed. The profile comprises a part 1 in the shape of a U, whose outer side 101 is lower and preferably of less thickness than the inner side 201. The part 1 is structurally stiffened by means of inner cross members 301 and it is provided on its base portion 401 with wide openings 2, which ensure a strong incorporation of the same portion of modular frame into the layer S of cement mortar which is employed for the installation of the frame according to the present invention. The openings 2 can also be employed for the passage of any possible anchoring member (not shown) for the installation of the frame.

The cross members 301 go along the whole height of the side portion 101 whereas they go just along a portion of the height of the side part 201, so that the upper edge of the same cross members is at a slope and the cross members themselves are completely enclosed within said layer S.

About at the middle of the inner side 201 of the part 1 mentioned above the end of the part 3 is fixed, said part being in the shape of an inverted L, so as to realize with the upper portion and viewing the side part 201 an S profile that defines the ledge C of the frame in question, said ledge being suitable to receive the cover, the grid, the door or any other movable closure member. The part 3 is coplanar at its lower portion to the part 1 mentioned above, and is connected to the same by means of inner stiffening cross member 103. The inner cavity of the part 3 is also in engagement with the cement mortar employed for fixing the frame when installing the same. It is to be understood that any possible openings can be provided on the length out of sight of the side part 201, in order to ensure an incorporation of the frame into the mortar layer S of even higher efficiency. Such openings could be open at the lower edge of the side part 201 and might be obtained with no particular complications in the structure of the mold for the production of the components A and B in question, all that being easily understandable and accomplished by those who are skilled in the art.

Some cross members 301 and 103 close the ends of the members A-A'-A" and B, forming in this way the planar fronts.

Figure 5:
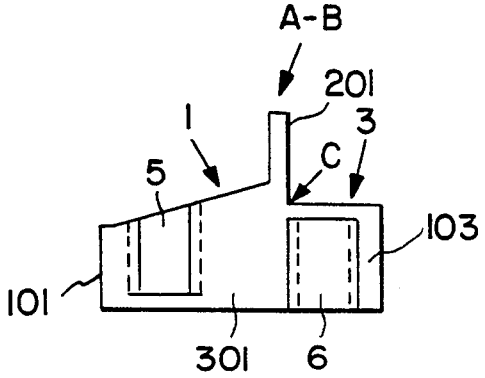
FIGS. 5 and 6 illustrate the components shown in FIGS. 1 and 2, as viewed from the fronts which are shown respectively by the arrows H and K.
Figure 6:
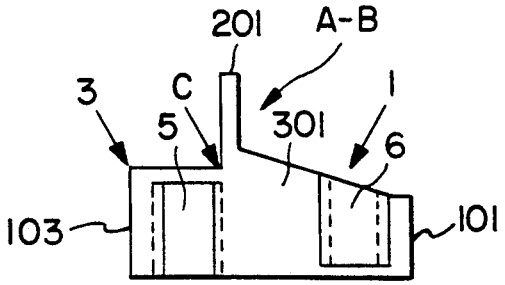

The intermediate members B (FIG. 2) are formed by a portion of suitable length of the modular frame disclosed with reference to FIGS. 4-5-6, for instance of 10 cm length. The angular member A (FIG. 1) is made up of two pieces of equal length (for instance of 10 cm length) of the modular frame disclosed above, which pieces are integral at one end and such as to form inner Z angles of 90°. The outer side 101 of the member A is rounded at the angular portion as shown by 101' and it is provided at the intermediate point with a break 4 that is also present in the base portion 401 of said modular frame. At the points corresponding to the break 4 the profiled parts 1 are provided with cross members 301' having preferably a thickness lower than that of the cross members 301 mentioned above. The break 4 in the angular portion of the member A allows the plastic materials which said member is made up of to shrink during the cooling phase next the molding step and avoids the occurence of undesired deformations of the same member A.

From FIGS. 1-6 it can be observed that two restraining coupling means are provided on the front portions of the member A and B, and, more precisely, a seat 5 which is in the shape of a dovetail, and a raised portion 6 which also has a dovetail shape and is complementary to said seat.

The longitudinal axis of the restraining or fixing means 5 and 6 is at right angles to a plane that contains the base portion 401 of the modular brame disclosed above. The raised portion 6 is provided at the point where the seat 5 is provided, on the other end of each element A and B, and in addition, as it can be seen from the detailed illustration of the FIGS. 5 and 6, a seat 5 is open in the upward direction on one end of the members A-B, whereas it is open downwards on the other end. As a consequence, the raised portions 6 of the two ends of the members A-B are staggered in a suitable way along their longitudinal axes. The restraining or fixing means so realized and so arranged ensure a very precise, strong and reliable connection of the members A and B to each other.

Figure 9:
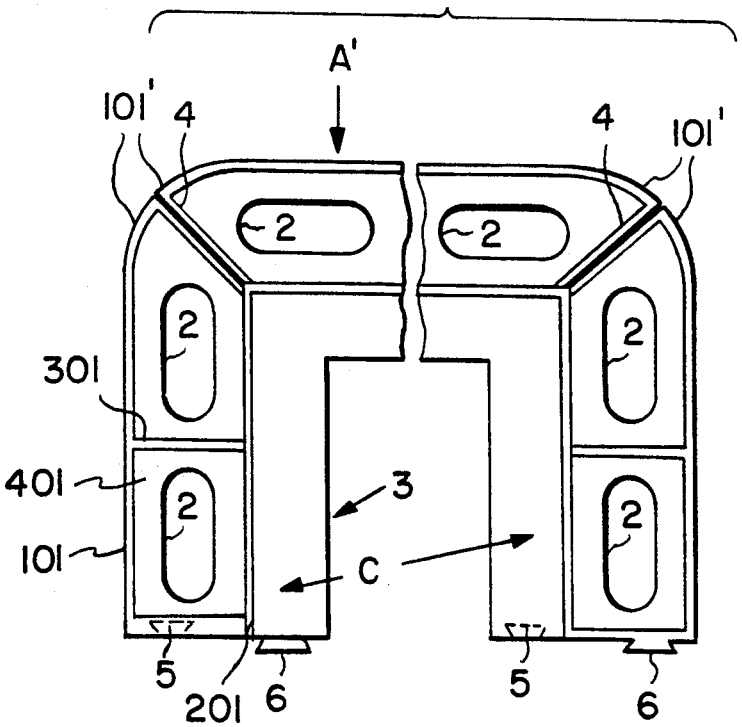
FIGS. 9, 10 and 11 show the top plan view of the various members involved in the realization of the angular portions of the frame.
Figure 10:
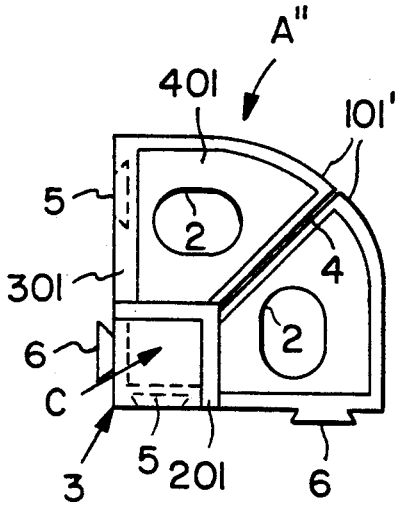
Figure 11:
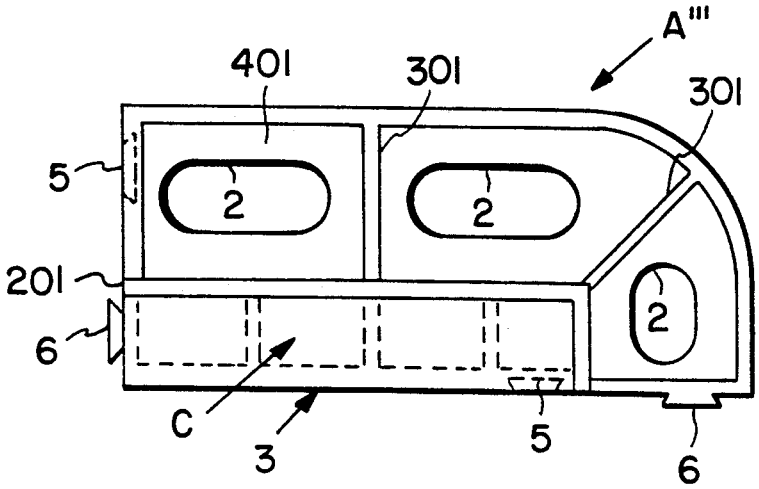

The end member A' illustrated in FIG. 9 comes out of the production mold with a U-shape as a plan view and is provided with means 5 and 6 at its ends for realizing the coupling with the straight-line members B. The angular member of FIG. 10 is derived from the angular member A of FIG. 1, by total removal of the sides of such member. The member A''' shown in FIG. 11 is made up, on the contrary of the member A, just for one half of its structure and of the member A'' of FIG. 10 for the other half of its structure. The cut 4 in the angular portion can be provided or it can also not be provided, as shown in FIG. 11.

It is to be understood that the disclosure is referred to some preferred embodiments of the present invention to which small changes and modifications can be made, allowing to obtain equal usefulness and adopting the same innovative conception, without departing from the spirit and scope of this invention as above disclosed and as illustrated in the enclosed drawings, and as claimed in the enclosed claims.

In the claims given below, the reference symbols in parentheses have been reported with the object to make it easier to read the claims themselves so that such symbols are not to be interpreted in a limitative way as regards the scope of the same claims.

I claim:

1. A modular rectangular plastic frame for defining and profiling the edges of wells, canalizations and other openings, said frame comprising: angular members (A-A'-A''-A''') that make 90° angle portions of the frame, straight-line intermediate members (B) that form sides of the same frame, said angular and straight-line intermediate members having ends with complementary restraining or fixing means, which allow said members to be connected to each other rapidly and precisely, each of both of said members comprising a part (1) having a U-shaped profile, with a side (201) whose height is higher than that of another side (101), inner stiffening ribs (301) which reach the height of the lowest side (101) but do not reach the height of the higher side (201) and integral with said sides (101) and (201), a bottom (401), openings (2) provided in the bottom (401), said higher side (201) having integral therewith a portion (3) with a profile of an inverted L, cross members (103) integral with said higher side (201) and a vertical portion of the inverted L, a horizontal portion of the inverted L defining a ledge (C) and cross elements closing the ends of said members, said complementary restraining or fixing means being integral with said cross elements.

2. The frame of claim 1, wherein each angular member (A-A'-A''-A''') is provided with a break (4) in an angular portion external to the ledge (C) and between two adjacent inner stiffening ribs.

3. The frame of claim 1, wherein said complementary restraining or fixing means define seats (5) and raised portions (6) extend vertically whose profiles are in the shape of a dovetail for connecting said members, seats (5) of the two opposite ends of each member are open, upwards on the end and downwards on the other end, and the raised portions (6) do not extend to the full vertical heights of the ends of the members.

4. The frame of claim 1, wherein each angular member in plan view is in the shape of a 90° angle.

5. The frame of claim 1, wherein the angular members are in the shape of a U in a plan view and define a portion of the frame of predetermined width.

6. The frame of claim 1, wherein the angular member (A'') is of a substantially square shape with one rounded corner in a plan view and is provided with at least two adjacent sides of equal length at right angle to one another, on said sides of which are present the fixing means.

7. The frame of claim 1, wherein the angular member (A''') is of substantially rectangular shape with one rounded corner in a plan view, fixing means (5-6) being on a side of said angular member (A''') defining a width of said frame and at the right angles, to fixing means in a side of said angular member (A''') defining an interior side of said frame.

8. The frame of claim 2, wherein each angular member in plan view is in the shape of a 90° angle.

9. The frame of claim 3, wherein each angular member in plan view is in the shape of a 90° angle.

10. The frame of claim 2, wherein the angular members are in the shape of a U in a plan view and define a portion of the frame of predetermined width.

11. The frame of claim 3, wherein the angular members are in the shape of a U in a plan view and define a portion of the frame of predetermined width.

12. The frame according to claim 2, wherein the angular member (A'') is of a substantially square shape with one rounded corner in a plan view and is provided with at least two adjacent sides of equal length at right angle to one another, on which the means (5-6) are provided for realizing a fixed coupling with the other members of the frame itself.

13. The frame according to claim 3, wherein the angular member (A'') is of a substantially square shape with one rounded corner in a plan view and is provided with at least two adjacent sides of equal length at right angle to one another, on which the means (5-6) are provided for realizing a fixed coupling with the other members of the frame itself.

14. The frame according to claim 2, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

15. The frame according to claim 3, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

16. The frame according to claim 4, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

17. The frame according to claim 5, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

18. The frame according to claim 6, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

19. The frame according to claim 8, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

20. The frame according to claim 9, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

21. The frame according to claim 10, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

22. The frame according to claim 11, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

23. The frame according to claim 12, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

24. The frame according to claim 13, wherein the angular member (A''') is of substantially rectangular shape with one rounded corner in a plan view, fixing means (5-6) being on a side of said angular member (A''') defining a width of said frame and at the right angles to fixing means and side of said angular member (A''') defining an interior side of said frame.

* * * * *